US011136214B2

(12) United States Patent
Melandri et al.

(10) Patent No.: US 11,136,214 B2
(45) Date of Patent: Oct. 5, 2021

(54) REEL HOLDER

(71) Applicant: Tetra Laval Holdings & Finance S.A., Pully (CH)

(72) Inventors: Antonio Melandri, Rubiera (IT); Paolo De Corte, Modena (IT); Marco Magnani, Reggio Emilia (IT); Marco Mazzali, Rio Saliceto (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 196 days.

(21) Appl. No.: 16/470,792

(22) PCT Filed: Dec. 4, 2017

(86) PCT No.: PCT/EP2017/081327
§ 371 (c)(1),
(2) Date: Jun. 18, 2019

(87) PCT Pub. No.: WO2018/114296
PCT Pub. Date: Jun. 28, 2018

(65) Prior Publication Data

US 2020/0017331 A1 Jan. 16, 2020

(30) Foreign Application Priority Data

Dec. 21, 2016 (EP) ..... 16205930

(51) Int. Cl.
*B65H 75/18* (2006.01)
*B65B 41/12* (2006.01)
(Continued)

(52) U.S. Cl.
CPC ..... *B65H 75/182* (2013.01); *B65B 41/12* (2013.01); *B65B 57/02* (2013.01); *B65H 16/06* (2013.01);
(Continued)

(58) Field of Classification Search
None
See application file for complete search history.

(56) References Cited

U.S. PATENT DOCUMENTS 8,544,785 B2 * 10/2013 Pelland ..... A47K 10/16 242/563
8,789,787 B2 * 7/2014 Kling ..... B65H 35/0066 242/563
(Continued)

FOREIGN PATENT DOCUMENTS

CN 104925288 A 9/2015
DE 102007033830 A1 1/2009
(Continued)

OTHER PUBLICATIONS

English translation of JP 2007-261769, Hayashi, Oct. 11, 2007 (Year: 2007).*
(Continued)

*Primary Examiner* — William A. Rivera
(74) *Attorney, Agent, or Firm* — Knobbe, Martens, Olson & Bear, LLP

(57) ABSTRACT

A reel holder is disclosed. In some embodiments, the reel holder comprises an opening configured to receive and hold a reel having packaging material and a transceiver configured to communicate with a tag in the reel to receive information stored in the tag. A filling machine system is also disclosed. In some embodiments, the filling machine system comprises a reel holder and a reel provided with a tag.

16 Claims, 5 Drawing Sheets

(51) Int. Cl.
*B65B 57/02* (2006.01)
*B65H 16/06* (2006.01)

(52) U.S. Cl.
CPC ..... *B65B 2210/04* (2013.01); *B65H 2553/52* (2013.01); *B65H 2701/1133* (2013.01); *B65H 2801/81* (2013.01)

(56) References Cited

U.S. PATENT DOCUMENTS 8,919,233 B2 * 12/2014 Lewis ..... B26F 3/02 83/361
10,045,668 B2 * 8/2018 Green ..... A47K 10/424
2005/0198920 A1 * 9/2005 Nakagawa ..... B65H 75/182 53/64
2005/0237199 A1 * 10/2005 Bellum ..... B65D 59/04 340/572.8
2008/0307754 A1 * 12/2008 Storig ..... B65B 11/008 53/461
2009/0293425 A1 * 12/2009 Carter ..... B65B 11/045 53/167
2010/0315195 A1 * 12/2010 Duron ..... H01Q 1/2216 340/5.1
2020/0148404 A1 * 5/2020 Melandri ..... B65B 57/02
2020/0371499 A1 * 11/2020 Ward ..... B65B 35/24

FOREIGN PATENT DOCUMENTS

EP 1266830 A1 12/2002
EP 1538084 A1 6/2005
EP 2213450 A2 8/2010
JP 2007-261769 A 10/2007
WO WO 2016/207125 A2 12/2016

OTHER PUBLICATIONS

Search Report and Written Opinion received in International Application No. PCT/EP2017/081327, dated Feb. 27, 2018, in 12 pages.
Search Report received in European Application No. 16205930.7, dated Jun. 29, 2017, in 11 pages.

* cited by examiner

REEL HOLDER

TECHNICAL FIELD

The present invention generally relates to the field of mechanical holders or supports for rotating reels. More particularly, the present invention relates to a reel holder for reels of packaging material, a filling machine system and a filling machine.

BACKGROUND

In the food packaging industry, packages are often made by carton based multi-layer laminates that are folded, filled with content, and sealed into packages. For most food packaging machines, the packaging material, e.g. a complex multi-layer packaging material, is provided in large rolls of packaging material, where each roll or reel contains packaging material for a large number of packages, often thousands of packages. The large reels with packaging material are pre-printed according to the food product that is filled into the package. The multi-layer packaging material also contains different layers depending on the product that is intended to be stored in the package. Some packaging materials are made for fresh products intended to keep chilled and to be consumed in a relatively near future, while other packing materials are intended for packages that are aseptic, in order to store food products for long periods of time. It is thus important that the correct packaging material is used for the intended product, both so that the correct print end up on the correct packaged product, and that the correct type of packaging material is used for the current product. The reels with packaging material are often fed to the packing or filling machine by a so called automatic splicing unit comprising two mandrels each intended to receive a reel of packaging material. When one reel is empty, the automatic splicing unit will automatically splice the beginning of the packaging material of the second reel onto the end of the packaging material of the first reel. If an incorrect reel is introduced into the automatic splicing unit and the incorrect reel is used, the filling machine has to be stopped, and it has to be cleaned before starting again, which may invoke large costs and result in a lot of wasted product. Thus, when handling large volumes of products, it is critical to maintain the matching between the product and the material provided by the reels. Further, previous solutions designed to facilitate the handling of the reels, having various packaging materials, in filling machines producing a variety of different products have been cumbersome to implement in existing filling machine environments and setups. While it would be highly desirable to use an existing setup, to avoid costly rebuilding of the machine, there are often difficulties arising from space constrains in the vicinity of the mandrels holding the reels.

Hence, an improved system for handling packaging materials would be advantageous and in particular allowing for avoiding more of the above mentioned problems and compromises, including reducing the risk of using a reel with incorrect packaging material.

SUMMARY

Accordingly, examples of the present invention preferably seeks to mitigate, alleviate or eliminate one or more deficiencies, disadvantages or issues in the art, such as the above-identified, singly or in any combination by providing a device according to the appended patent claims.

According to a first aspect a reel holder is provided comprising an opening for receiving and holding a reel provided with packaging material, and a transceiver adapted to communicate with a tag provided in said reel in order to receive information stored in said tag.

According to a second aspect a filling machine system is provided comprising a reel holder according to the first aspect and a reel provided with a tag, said reel holder comprising a transceiver adapted to communicate with said tag in order to receive information stored in said tag.

Further examples of the invention are defined in the dependent claims, wherein features for the second aspect of the disclosure are as for the first aspect mutatis mutandis.

Some examples of the disclosure provide for an improved reel holder that facilitates identification of a packaging material provided on a reel.

Some examples of the disclosure provide for a reel holder that allows a more accurate or reliable identification of a packaging material provided on a reel.

Some examples of the disclosure provide for increased accuracy in identifying of a packaging material while provided on a rotating reel.

Some examples of the disclosure provide for a more compact system for identifying a packaging material provided on a reel.

Some examples of the disclosure provide for a more robust reel holder while also being able to allow identification of a packaging material provided on a reel.

Some examples of the disclosure provide for an improved reel holder that is easier to implement in existing filling machines.

Some examples of the disclosure provide for a less costly implementation of a packaging material identification system on existing filling machines.

Some examples of the disclosure provide for an improved integration of a packaging material identification system in an existing communication network controlling a filling machine.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

These and other aspects, features and advantages of which examples of the invention are capable of will be apparent and elucidated from the following description of examples of the present invention, reference being made to the accompanying drawings, in which.

DETAILED DESCRIPTION

Figure 1:
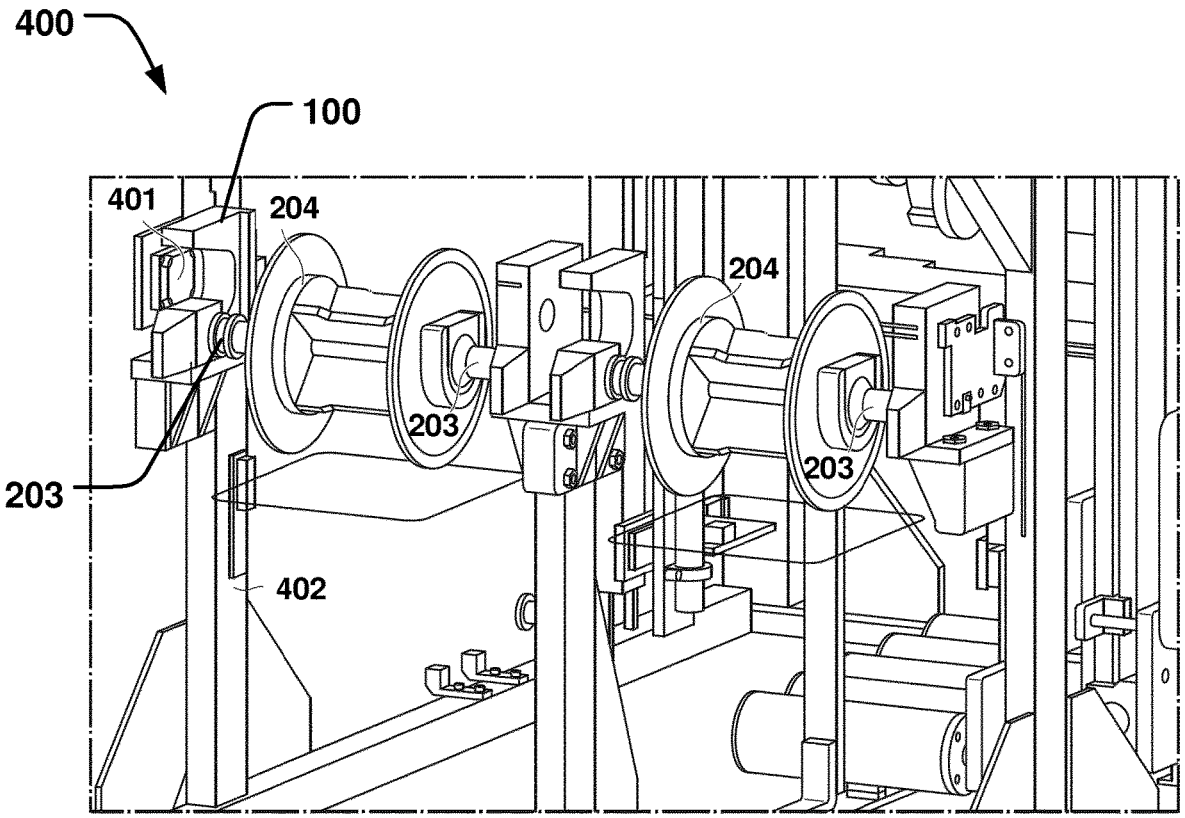
FIG. 1 is a schematic illustration of an example of a filling machine having a filling machine system of a reel holder and a reel that holds a packaging material.

Specific examples of the invention will now be described with reference to the accompanying drawings. This invention may, however, be embodied in many different forms and should not be construed as limited to the examples set forth herein; rather, these examples are provided so that this disclosure will be thorough and complete, and will fully convey the scope of the invention to those skilled in the art. The terminology used in the detailed description of the examples illustrated in the accompanying drawings is not intended to be limiting of the invention. In the drawings, like numbers refer to like elements.

Figure 4:
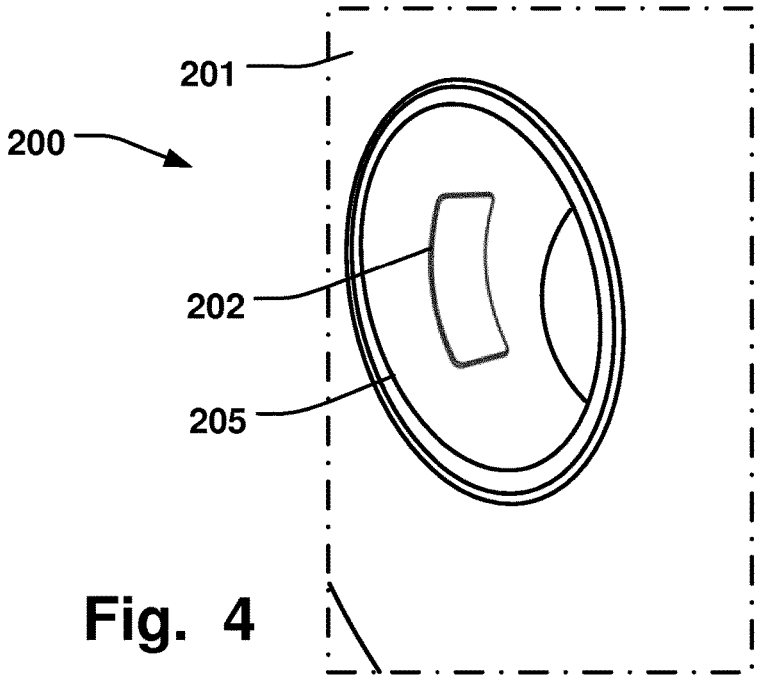
FIG. 4 is a schematic illustration of an example of a reel to be held in the reel holder.

FIG. 1 illustrates a filling machine 400, having mandrels 204 being adapted to carry the reels 200. A reel 200 provided with a packaging material 201 is illustrated in FIG. 4. The packaging material 201 is wound up on a central cylinder 205 of the reel 200, and the mandrel 204 is adapted to be inserted into the central cylinder 205 in order to hold the reel 200. Each of the mandrels 204 are able to rotate around central axis 203. The axis 203 is rotatably received in holders 100 on each side of the respective mandrels 204. The holders 100 are mounted in a frame 402 of the filling machine 400, to provide a fixation of the reels 200 in relation to the filling machine 400. The packaging material 201 is then transported from the reels 200 into the filling machine 400 to be processed.

Figure 2A:
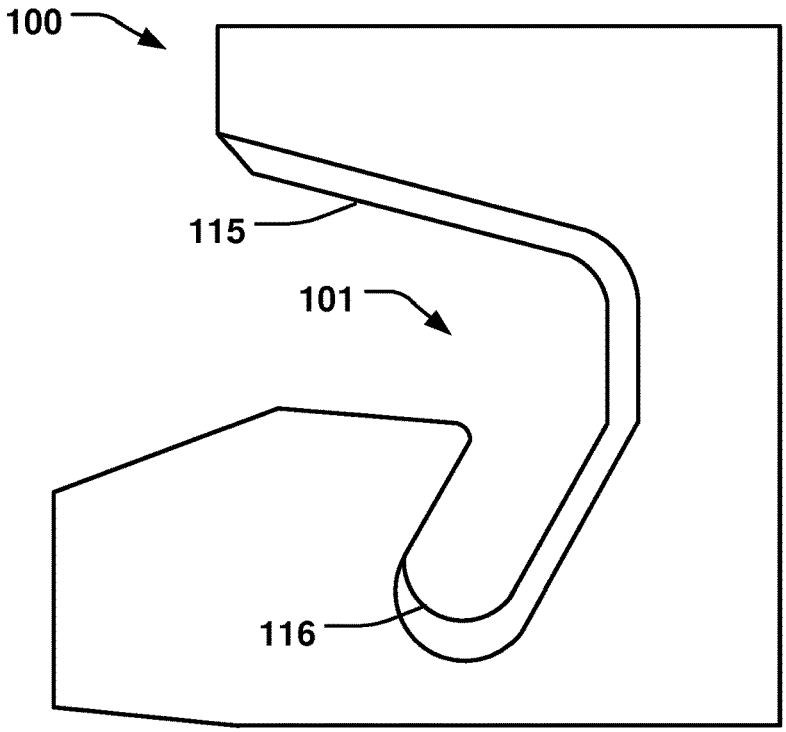
FIG. 2*a* is a schematic illustration of an example of a reel holder.

FIG. 2*a* illustrates a reel holder 100 comprising an opening 101 for receiving and holding a reel 200 provided with packaging material 201. The opening 101 may be arranged so that insertion of the axis 203 of the reel 200 is facilitated. For example, the opening 101 may comprise a guiding portion 115 having wider opening than the portion 116 of the opening 101 that fixates the axis 203 in its final position. The guiding portion 115 may be open outwards in a horizontal direction, as illustrated in FIG. 2*a*, in order to provide for insertion of the reel 200 from the side. The holder 100 may also comprise further guiding surfaces 117, 118, which tapers away from the final position 116 of the axis 203 in order to further guide the axis 203 into the opening 101 and the final position 116 of the holder 101 if needed.

Figure 2B:
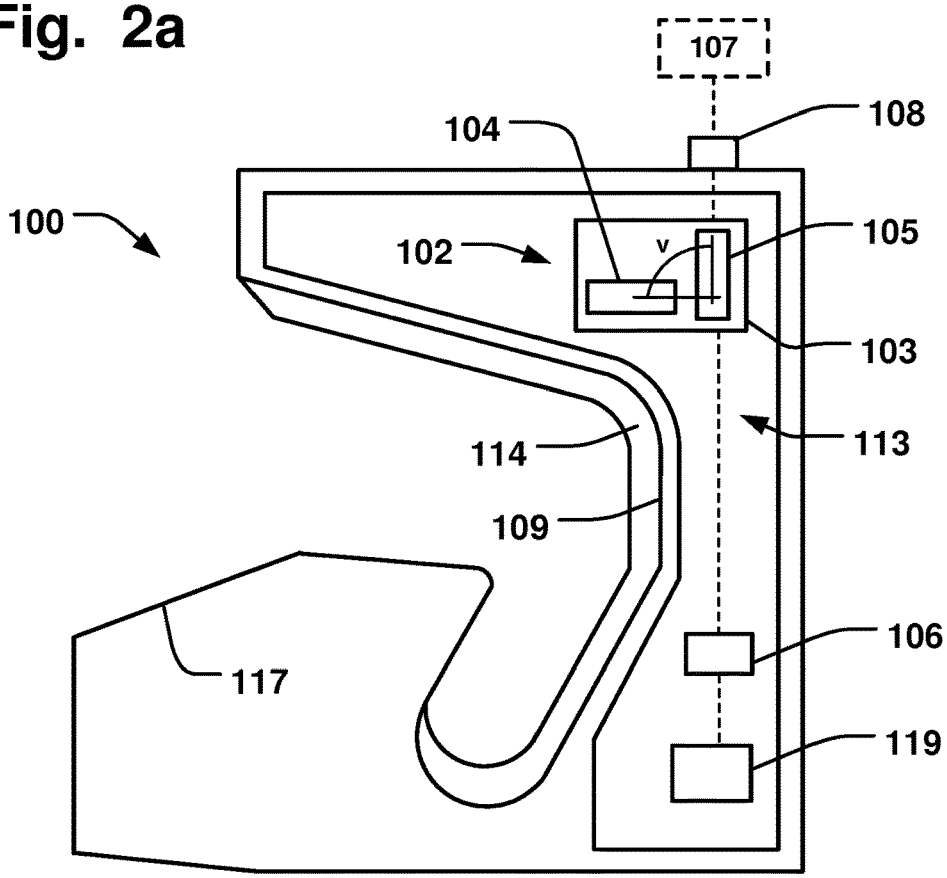
FIG. 2*b* is a schematic illustration of an example of a reel holder as seen in FIG. 2*a*, but with a cut-out to see the interior of the reel holder.

The holder 100 further comprises a transceiver 102 adapted to communicate with a tag 202 provided in the reel 200 in order to receive information stored in the tag 202. This allows for identification of the reel 200, i.e. identification of the packaging material 201 provided on the reel 200, via the holder 100 itself. Thus, no additional modifications are needed to the filling machine 400, such as incorporating auxiliary equipment to allow for such identification of the packaging material 201, which may be cumbersome to implement in an existing setup, e.g. due to space constrains. Also, by having a transceiver 102 in the holder 100, the communication path with the tag 202 provided in the reel 200 is optimized, since the distance between the transceiver 102 and the tag can be minimized. This allows for a more accurate and reliable communication between the transceiver 102 and the tag 202. This is particularly critical in the present application since the reel 200, and consequently also the tag 201, rotates with high speed in order to maintain a high throughput of the filling machine 400. FIG. 1 shows a previous solution where an antenna 401 is placed in the frame of the filling machine 400. This solution increases the distance of the communication path, and is a less reliable solution. Further, due to the mentioned space constrains, the antenna 401 is placed adjacent the holder, and may thereby interfere with the loading of the reel in the filling machine 400. By having a holder 100 comprising the transceiver 102, the loading of the reel 200 can be facilitated, while maintaining a highly reliable readout signal from the tag 201, even in high speed applications. This advantageously also provides for facilitated upgrades of existing filling machines 400 to be able to accurately and reliably identify the packaging material used, since only the reel holder needs to be replaced, due to the reel holder 100 incorporating the transceiver 102. FIG. 2*b* schematically illustrates a view of an internal section of the holder 100 in FIG. 2*a*. The transceiver 102 may thus be positioned internally of the holder 100, and/or the transceiver 102 may be arranged adjacent the surface 111 facing the reel 200 (see FIG. 5).

Figure 3:
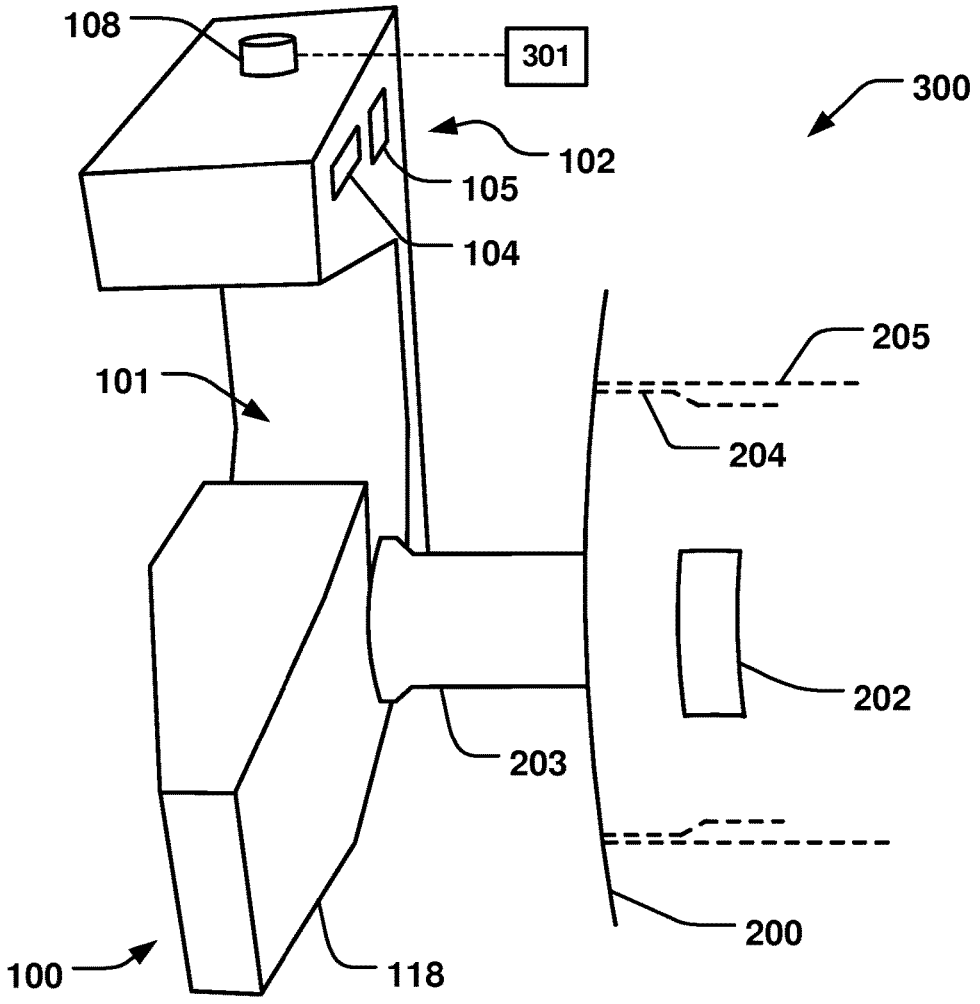
FIG. 3 is a schematic illustration, in a perspective view, of an example of a reel holder holding a reel.

FIG. 3 illustrates the reel holder 100 and a reel 200, provided with a tag 202, being position in the opening 101 of the holder 100. I.e. the mandrel 204 is inserted into the cylindrical portion 205 of the reel 200, and the axis 203 of the mandrel 204 is positioned in the opening 101. The tag 202 is also illustrated in FIG. 4, as it is positioned in the cylindrical portion 205 of the reel 200. Thus, as seen in the perspective view of FIG. 3, the transceiver 102 can be placed in close vicinity with the mandrel 204 and the cylindrical portion 205 of the reel 200, being provided with the tag 202, to optimize the communication path, without interfering with the loading of the reel 200 into the opening 101 or otherwise occupy unnecessary space in the vicinity of the mandrel 204.

The transceiver 102 may comprise an antenna 103 being oriented in a predetermined angle, towards the reel 200, determined in dependence of an average signal strength at which the information from the tag 202 is received, when the reel 200 is received and rotating in the opening 101. Thus, by adapting the position of the antenna 103 in dependence of the detected signal strength, which fluctuates as the tag 202 is not stationary but rotates with the reel 200, the detection can be made more accurate and reliable. This is also a particular challenge in the present application since the packaging material 201 may comprise a laminate that shields electromagnetic radiation, such as a metallic sheet in the laminate. The optimized angle and position of the antenna 103 thus improves the communication with the tag 202.

Figure 5:
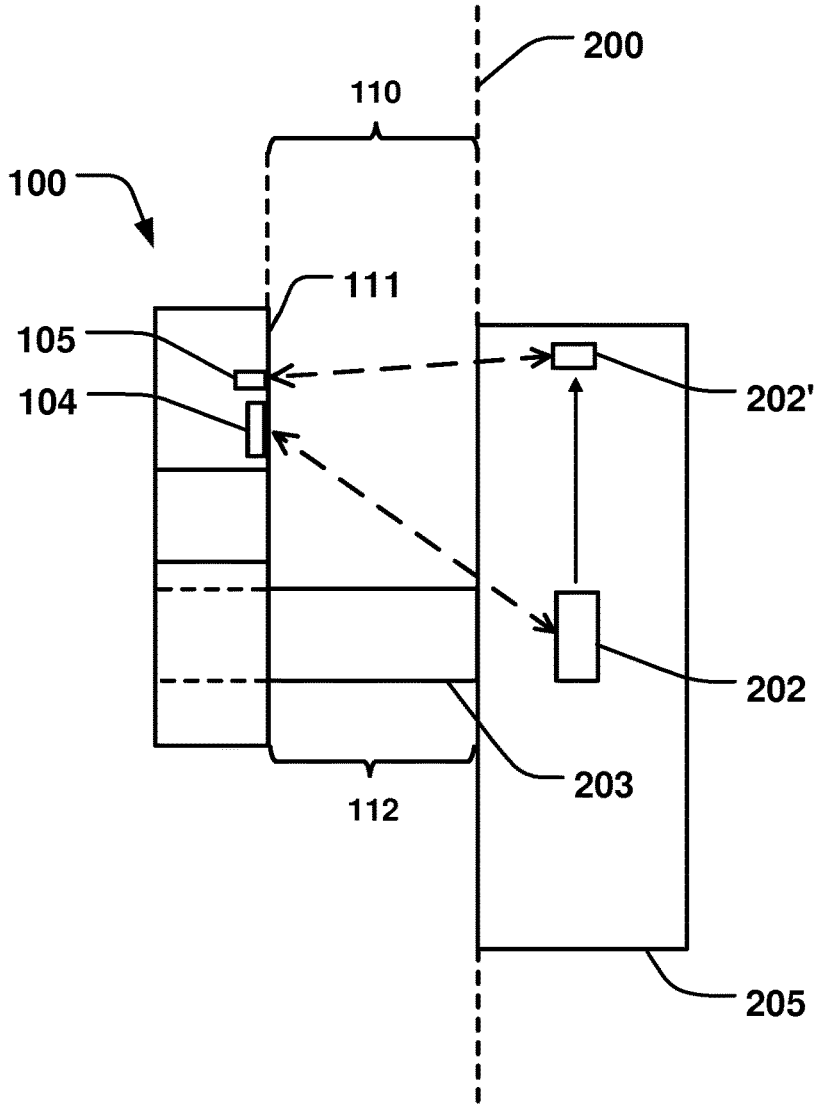
FIG. 5 is a schematic illustration, in a side view, of an example of a reel holder holding a reel.

The antenna 103 may have two dipoles 104, 105, placed at an angle apart (v) determined in dependence of an average signal strength at which the information is received by the two dipoles, when the reel 200 is received and rotating in the opening 101. FIG. 2*b* illustrates schematically how the two dipoles are oriented at an angle (v) apart. FIG. 5 further illustrates the two dipoles and how the communication path may change as the tag 202 rotates with the reel 200. Thus, each dipole may be oriented to provide for maximum signal strength in communication with the tag 202. For example, as the tag 202 is positioned substantially vertically in the reel 200, i.e. in the position denoted with reference 202 in FIG. 5, a first dipole 104 may be oriented in an angle to provide the maximum signal with the tag 202 in this position. The second dipole 105 may be oriented in an angle to have a maximum signal strength when the tag has rotated 90 degrees, so that it is positioned substantially horizontal in the reel 200, i.e. in the position denoted with reference 202' in FIG. 5. In this case, the second dipole 105 will also provide the maximum signal strength when the tag has rotated another 180 degrees, i.e. being positioned in lowermost position in the reel 200. This will also be the case with respect to the first dipole 104, when the tag has rotated 180 degrees from the position 202 to the corresponding vertical position on the opposite side of the reel 200. The first dipole 104 may be linearly polarized in the horizontal direction, and the second dipole 105 may be linearly polarized in the vertical direction, or vice versa. It is also conceivable that the antenna 103 is circularly polarized.

The reel holder 100 may comprise an impedance matching circuit 106 connected to the transceiver 102, as schematically illustrated in FIG. 2*b*. The impedance matching circuit 106 may be adapted to couple the transceiver 102 with an external circuit network 107 at a determined impedance. The holder 100 may thus comprise the circuit components required to facilitate connection to an existing network of components (schematically denoted 107 in FIG. 2*b*), which may have a varying impedance. A holder 100 having such self-contained circuit eases the replacement of existing previous holders, and provides for a compact setup.

The reel holder 100 may comprise an interface unit 108 connected to the transceiver 102. The interface unit 108 may be adapted to communicate with the external circuit network 107 via the impedance matching circuit 106. Thus, the interface unit 108 allows for connecting the holder 100 to external communication via the impedance matching circuit 106. The interface unit 108 may comprise a wired or wireless connection interface to the external circuit network 107. The holder 100 may further comprise a processing unit 119, connected to the impedance matching circuit 106, the transceiver 102 and the interface unit 108, to control the communication between the holder 100 and the external network 107.

The transceiver 102 may be integrated into a casing 109 of the holder 100. The casing 109 also defines the opening 101 that receives and holds the reel 200. I.e. as mentioned above, the opening 101 is adapted to receive the axle 203 of the mandrel 204 on which the reel 200 is mounted. The transceiver 102 may thus be integrated into the casing 102 of the holder 100 itself, which holds the axel 203 of the reel 200. This provides for positioning the transceiver 102 as close to the reel 200 as possible, with the advantages of improving the signal strength and minimizing the occupied space when integrated in a filling machine 400, and further facilitating the integration in existing machines, as further elucidated above.

The transceiver 102 may be arranged in the casing 109 so that the shortest distance between the reel 200 and the transceiver 102 substantially corresponds to the horizontal spacing 110 between the reel 200 and a side 111 of the reel holder 100 facing the reel 200. This is schematically illustrated in FIG. 5, where it is also shown that the horizontal spacing 110 is defined by the length of a portion 112 of the axle 203 extending between the side 111 of the holder 100 facing the reel 200 and the reel 200 itself. By having the transceiver 102 arranged in the casing 109 so that the shortest distance between the reel 200 and the transceiver 102 substantially corresponds to the horizontal spacing 110, the length of the communication path can be minimized, and the average signal strength can be improved. The transceiver 102 may thus be arranged close to the surface of the side 111 facing the reel 200. The transceiver 102 and related components as discussed above may be fully contained in the casing 109 of the holder 100. It is also conceivable that the transceiver 102 may be at least partly arranged on the surface of the side 111 facing the reel 200, for example having an antenna 103 extending towards the reel 200. And/or the casing 109 may have apertures (not shown) that improve the transmission of signal to the transceiver 102 through the casing 109.

Figure 6:
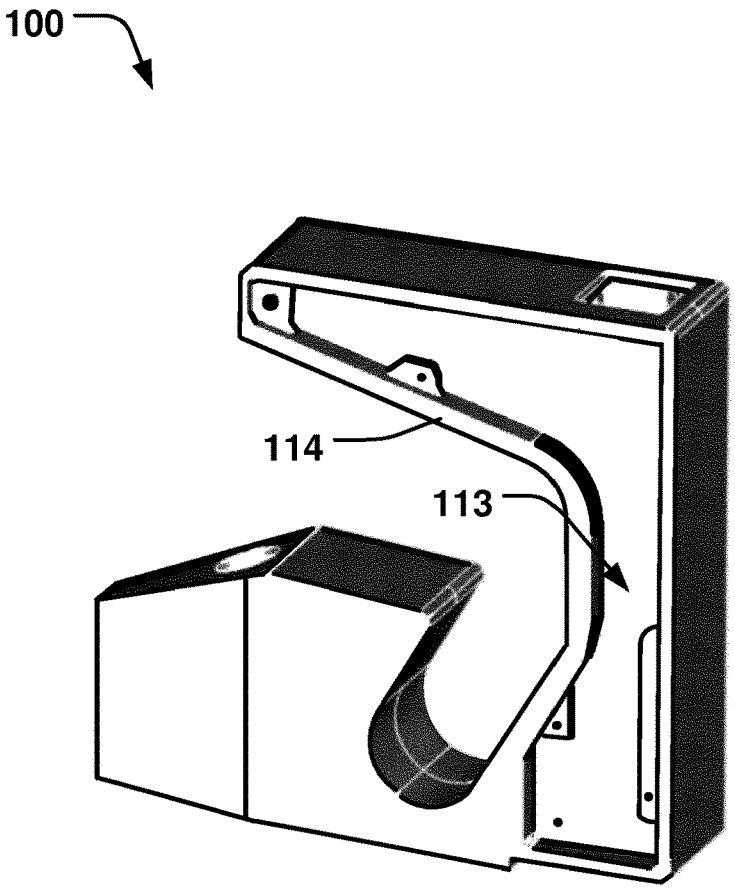
FIG. 6 is a schematic illustration, in a perspective view, of an example of a reel holder with a cut-out to see the interior of the reel holder.

The transceiver 102 may be arranged in a cavity 113 formed in a monolithic piece 114 of the casing 109. FIG. 6 illustrates the holder 100 being a solid piece of material 114 in which the cavity 113 has been formed, e.g. by a milling process. This allows for integration of the transceiver 102 in the holder 100 to achieve a compact profile of the holder 100, while maintaining the required structural integrity of the holder 100 to be able to hold the reel 200, which may carry several tons of packaging material 201.

As elucidated above, the information received by the transceiver 102 from the tag 202 may comprise data describing the packaging material 201. Thus, it is possible to ascertain that the packaging material 201 of the current reel 200 mounted in the filling machine 400 matches the particular product that is going to be produced.

A filling machine system 300 is also provided according to the present disclosure. The filling machine system 300 comprises the reel holder 100 as described above, and a reel 200 provided with a tag 202. The reel holder 100 comprises the transceiver 102 as described above, being adapted to communicate with the tag 202 of the reel 200 in order to receive information stored in the tag 202.

The transceiver 102 may be arranged adjacent to the reel 200 and near an axle 203 of the reel 200 such that a radio communication path between the transceiver 102 and the tag 202 is not hindered by the reel 200. This provides for optimizing the communication path, and improving the reliability of the communication, in particular since the reel 200 may be carrying a packaging material 201 comprising a laminate having an electromagnetically shielding material. FIG. 3 illustrates the transceiver 102 in the upper part of the holder 100. It is also conceivable that the transceiver 102 is placed in other parts of the holder 100 to optimize the communication path, for example in the middle or lower part of the holder 100.

The reel 200 may be provided on a mandrel 204 which is manufactured from a radio frequency transparent material. The mandrel 204 may be manufactured by a radio frequency transparent material in order to avoid interference of the radio communication between the transceiver 102 and the tag 202. The radio frequency transparent material may comprise nylon especially suitable for this purpose.

The tag 202 may be an RFID tag, such as an HF-tag, a UHF-tag or an NFC-tag. Typically the tag 202 may have an antenna (not shown) for receiving an induction radio signal and for sending a response to an induction radio signal. The antenna may be arranged under the top side of the tag 202 and cover most of the area of the tag. The tag 202 may be rectangular or oblong and may be positioned with its length side perpendicular to the center axis 203 of the reel 200 to optimize the area of the antenna (not shown) of the tag 202 that is exposed to the radio signal from the transceiver 102.

The filling machine system 300 may be adapted to be arranged in a filling machine 400, and the reel holder 100 may be adapted to be removably fixated in the filling machine 400 in relation to the reel 200. This provides for facilitated integration of the holder 100 in existing filling machines 400, to provide for the above mentioned benefits of the holder 100.

Thus, the filling machine system 300 may be adapted to be arranged in a filling machine 400, and the filling machine system 300 may further comprise a control unit 301, schematically illustrated in FIG. 3, adapted to control the filling machine 400 based on information retrieved from the tag 202. Accordingly, the process of reading the information stored in the tag 202 and controlling the filling machine 400 based on the information may be completely automated. Should a reel 200 with the wrong type of packaging material be mounted on the mandrel 204 of the filling machine 400 it may be registered by the control unit 301, which in turn could trigger an alarm or the like.

It should be readily understood that the general principle of the above description is applicable to a variety of applications for manufacturing packaging containers where the packaging material varies among a variety of different types of containers, not only for food products.

The present invention has been described above with reference to specific examples. However, other examples than the above described are equally possible within the scope of the invention. The different features and steps of the invention may be combined in other combinations than those described. The scope of the invention is only limited by the appended patent claims.

More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used.

The invention claimed is:

1. A reel holder comprising:

an opening configured to receive and hold a reel having packaging material; and a transceiver configured to communicate with a tag in said reel to receive information stored in said tag;

wherein said transceiver is integrated into a casing of said reel holder, said casing defining said opening for receiving and holding said reel, and wherein said opening is configured to receive an axle of a mandrel on which said reel is mounted when holding said reel.

2. The reel holder according to claim 1, wherein said transceiver comprises an antenna oriented in a predetermined angle towards said reel, wherein the predetermined angle is determined based on_an average signal strength at which said information is received by the transceiver when said reel is received and rotating in said opening.

3. The reel holder according to claim 2, wherein said antenna has two dipoles placed at an angle apart, said angle determined based on an average signal strength at which said information is received by said two dipoles when said reel is received and rotating in said opening.

4. The reel holder according to claim 1, further comprising an impedance matching circuit connected to said transceiver, said impedance matching circuit configured to couple the transceiver with an external circuit network at a determined impedance.

5. The reel holder according to claim 4, further comprising an interface unit connected to said transceiver, said interface unit configured to communicate with said external circuit network via said impedance matching circuit.

6. The reel holder according to claim 1, wherein said transceiver is arranged in said casing so that a shortest distance between the reel and the transceiver substantially corresponds to a horizontal spacing between the reel and a side of the reel holder facing the reel, said horizontal spacing being defined by a length of a portion of said axle extending therebetween.

7. The reel holder according to claim 1, wherein said transceiver is arranged in a cavity formed in a monolithic piece of said casing.

8. The reel holder according to claim 1, wherein said information comprises data describing said packaging material.

9. A filling machine system comprising the reel holder according to claim 1, and further comprising said reel having said tag.

10. The filling machine system according to claim 9, wherein said transceiver is arranged adjacent to said reel and near an axle of said reel such that a radio communication path between said transceiver and said tag is not hindered by said reel.

11. The filling machine system according to claim 9, wherein said reel is provided on a mandrel which is manufactured from a radio frequency transparent material.

12. The filling machine system according to claim 9, wherein said tag is an RFID tag.

13. The filling machine system according to claim 9, wherein the system is configured for arrangement in a filling machine, and wherein said reel holder is configured to be removably positioned in said filling machine in relation to said reel.

14. The filling machine system according to claim 9, wherein the system is configured for arrangement in a filling machine, said filling machine system further comprising a control unit configured to control said filling machine based on information retrieved from said tag.

15. A reel holder comprising:

an opening configured to receive and hold a reel having packaging material;

a transceiver configured to communicate with a tag in said reel to receive information stored in said tag; and an impedance matching circuit connected to said transceiver, said impedance matching circuit configured to couple the transceiver with an external circuit network at a determined impedance.

16. The reel holder according to claim 15, further comprising an interface unit connected to said transceiver, said interface unit configured to communicate with said external circuit network via said impedance matching circuit.

* * * * *